US005165860A

United States Patent [19]

Stoner et al.

[11] Patent Number: 5,165,860

[45] Date of Patent: Nov. 24, 1992

[54] DAMPED AIRFOIL BLADE

[75] Inventors: Alan W. Stoner, Palm Beach Gardens; Yehia M. El-Aini, Jupiter; David Wiebe, Palm Beach Gardens, all of Fla.

[73] Assignee: United Technologies Corporation, Hartford, Conn.

[21] Appl. No.: 702,534

[22] Filed: May 20, 1991

[51] Int. Cl.[5] ..... F01D 5/16

[52] U.S. Cl. ..... 416/224; 416/500

[58] Field of Search ..... 416/224, 500

[56] References Cited

U.S. PATENT DOCUMENTS

| | | | |
|---|---|---|---|
| 2,689,107 | 9/1954 | Odegaard . | |
| 2,809,802 | 10/1957 | Suits | 416/500 |
| 2,920,868 | 1/1960 | Ackerman et al. . | |
| 2,984,453 | 5/1961 | Heymann | 416/500 |
| 3,027,138 | 3/1962 | Howell et al. | 416/500 |
| 5,056,738 | 10/1991 | Mercer et al. | 416/500 |

FOREIGN PATENT DOCUMENTS

| | | | |
|---|---|---|---|
| 0535074 | 12/1956 | Canada | 416/500 |
| 981599 | 1/1951 | France . | |
| 1007303 | 2/1952 | France . | |
| 641129 | 1/1979 | U.S.S.R. . | |

OTHER PUBLICATIONS

Journal of Engineering for Power Publication entitled "Friction Damping of Resonant Stresses in Gas Turbine Engine Airfoils".

*Primary Examiner*—Edward K. Look
*Assistant Examiner*—Christopher M. Verdier
*Attorney, Agent, or Firm*—Edward L. Kochey, Jr.

[57] ABSTRACT

The internal blade damper is an elongated member with a damping surface of discrete width in contact with the interior blade surfaces. Contact is continuous throughout a substantial length. The damper extends between 2° and 30° from the radial direction, producing a direction of contact having some radial component. Centrifugal force loads the damping surface.

12 Claims, 3 Drawing Sheets

DAMPED AIRFOIL BLADE

The Government has rights in this invention pursuant to a contract awarded by the Department of the Air Force.

TECHNICAL FIELD

The invention relates to hollow blades for gas turbine engines and in particular to vibration damping of such blades.

BACKGROUND OF THE INVENTION

Airfoil blades in both compressors and turbines of gas turbine engines are subject to high, sometimes pulsating forces. Blades can experience high vibratory stresses resulting from resonance or flutter instabilities. This is particularly true for hollow blades which are used to reduce weight and/or permit internal air cooling.

External restraints such as shrouds and platform dampers have been used to control the vibration problem. Internal dampers relying on impact or dry friction have also been suggested. These have packed the blades with particles or rods, or otherwise tended to wedge the dampers. This can overload and lock the damping action.

Frictional damping inherently requires some slipping. Such slippage can be broken into macro slip and micro slip action. Macro slip is defined as substantially single point contact while micro slip is defined as a slip phenomena occurring over multiple points along the line of surface. In micro slip all points of contact are not necessarily stuck or slipping simultaneously. The pattern of local stick or slip depends on the local normal load and local deformation between the materials of the two contact surfaces.

Both micro slip and macro slip theories indicate that the vibratory response is minimized when the damper stiffness is increased. In typical applications of turbine engines to ensure high stiffness with a functionally single point contact results in a heavy damper configuration. This heavy damper configuration tends to promote sticking of the damper because of excess loading.

Those approaches which involve wedging of the damper against the surface tend to promote high loading leading to jamming or sticking of the damper rendering it ineffective.

While dampers of the prior art may have had some micro slipping along with the macro slipping, the structure was selected based on macro slip concepts. Appreciation of the micro slip phenomena and the definition of new structure to take advantage of this phenomena provides a damper of light weight, less prone to locking, and more compatible with cooling air flow within a turbine blade.

SUMMARY OF THE INVENTION

A hollow airfoil blade is secured to a rotor disk either as a bonded blade or with a fir-tree type construction. The blade has interior surfaces and an effective radial length exposed to the gas flow through the gas turbine engine.

The internal damper comprises an elongated member with a damping surface of discrete width in contact with an interior surface of the blade. This contact is continuous throughout a contact length greater than 50% of the effective radial length. The contact is in the direction having a radial component with respect to the axis of the rotor, preferably with the damper extending between 2° and 30° from the radial direction. This damping surface is the exclusive frictional contact between the damper and the blade.

The damper cross-section is in the order of 0.2 inch by 0.06 inch with the major dimension being across the damping surface. This provides a damper stiffer in a direction parallel to the damping surface than in a direction perpendicular to the damping surface. Accordingly, the damper may readily conform to the wall to produce the continuous contact.

DESCRIPTION OF THE PREFERRED EMBODIMENT

Figure 1:
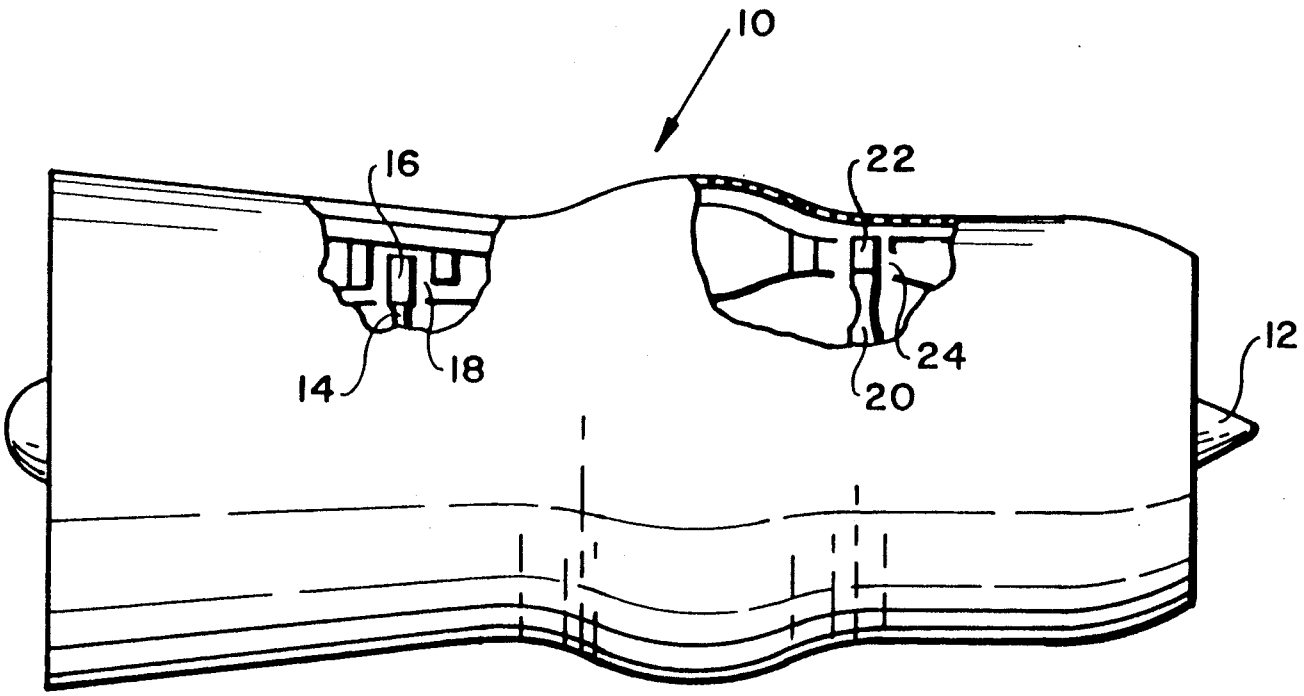
FIG. 1 illustrates a gas turbine engine showing several airfoil locations.
Figure 3:
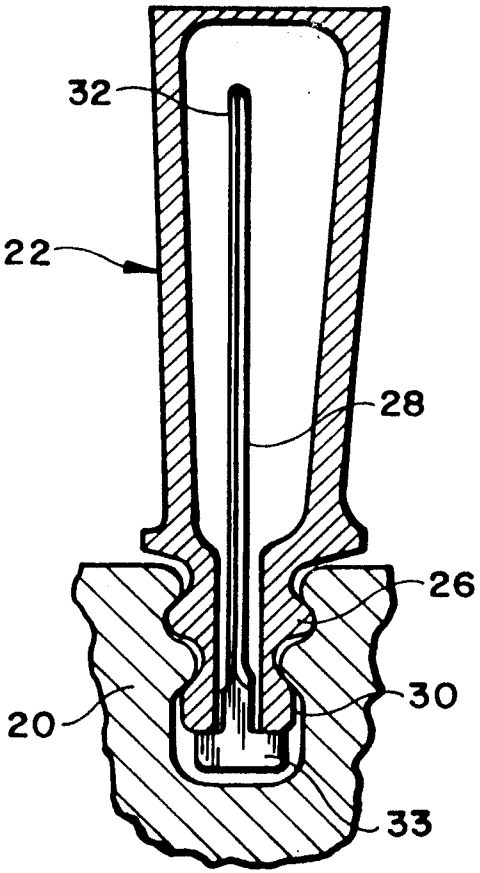
FIG. 3 is an axially looking view of an airfoil with a damper.
Figure 2:
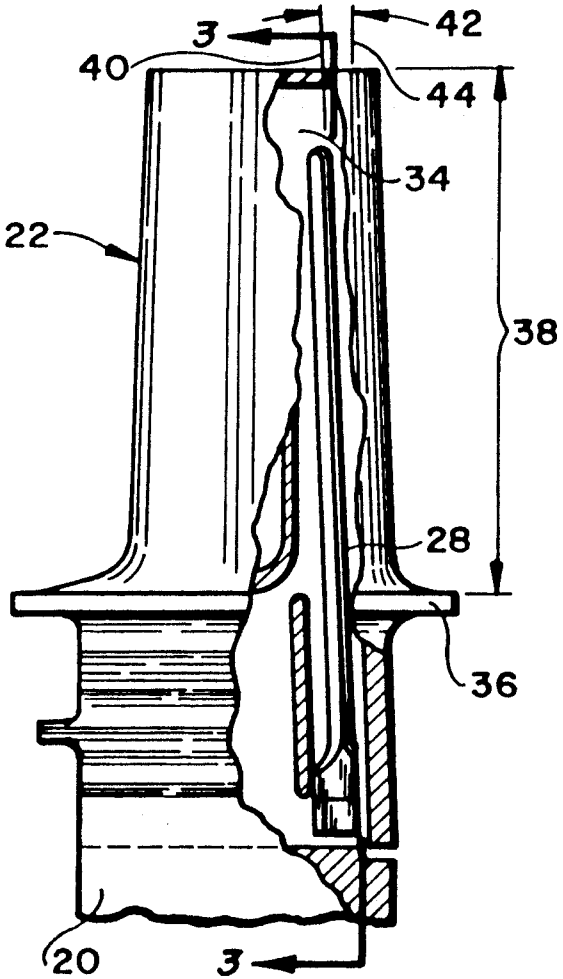
FIG. 2 is a circumferential looking view of an airfoil with a damper.

FIG. 1 illustrates a gas turbine engine 10 with rotor 12 including a compressor disk 14. The compressor disk carries compressor airfoil blade 16 located in the gas flow path 18.

Also on the rotor is a turbine disk 20 carrying a plurality of turbine airfoil blades 22 located in the gas flow path 24.

FIGS. 2, 3, 4 and 5 illustrate the use of the damper within a gas turbine airfoil blade 22. The airfoil blade is secured to the disk 20 by fir-tree 26 and damper 28 is secured or restrained at an inboard location 30 on the blade by lug 33. The damper extends outboard from this location. Damping surface 32 of the damper is 0.20 inch wide and is in contact with interior surface 34 of the blade throughout the entire length of the blade beyond platform 36. The distance 38 from the blade platform to the tip of the blade is the portion of the blade in contact with the gas flow 24 and is considered the effective radial length of the blade since this is a major factor in the vibration of the blade. The damping surface 32 should be in contact with the inner surface 34 continuously throughout a length equal to at least 50% of the effective radial length 38 of the blade.

The damper as illustrated here is 0.06 inch thick and 0.2 inch wide. This may be as low as 0.04 inch thick and 0.1 inch wide. In any event it is required that there be a discrete width of the damping surface in contact with the inner surface of the blade to provide a basis for the micro slip phenomena to occur. 0.1–0.2 inch is appropriate.

When installed against the inner surface of the blade the direction of the damping surface 32 is indicated by line 40 which is at an angle 42 of 3° with respect to the radial line 44. The centrifugal force operating on the damper forces the damper against the internal blade surface so long as this damping surface has some radial component with respect to the axis of the rotor. An angle of less than 2° will not provide sufficient loading against the surface while an angle exceeding 30° will produce too much loading leading to locking of the damper with loss of the energy dissipation capability.

Figure 4:
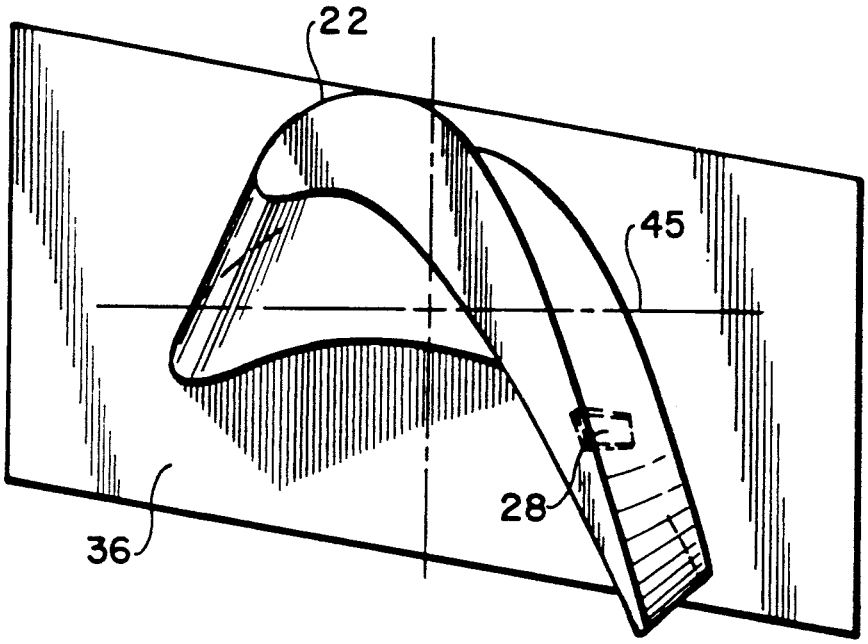
FIG. 4 is a top view of an airfoil with a damper.
Figure 5:
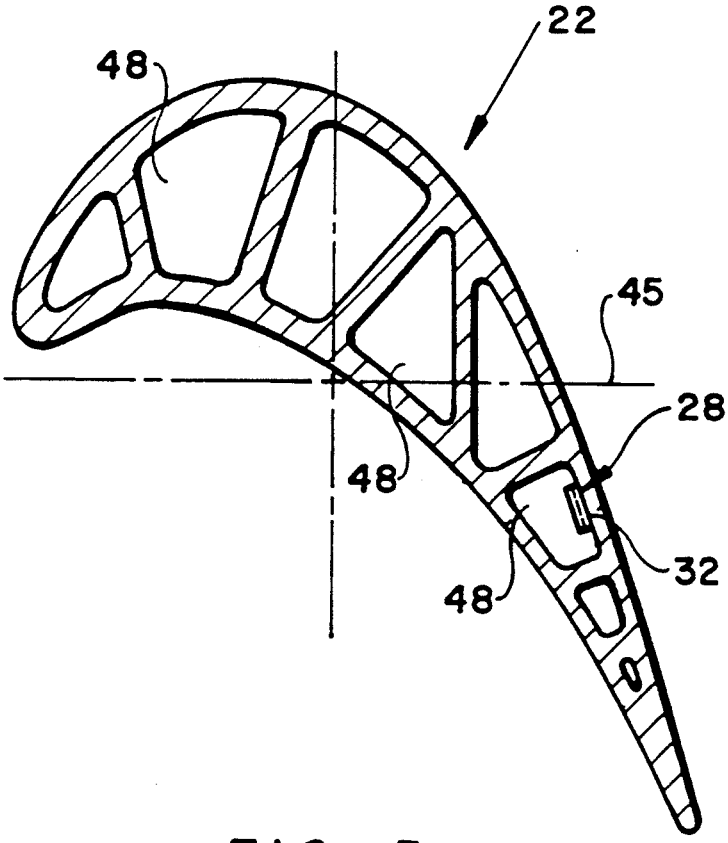
FIG. 5 is a section through the airfoil.

As best seen in FIG. 4, the damper is preferably set in a radial plane through the rotor axis. With this orientation the centrifugal force establishes no direct force on the damper in the direction which is perpendicular to the engine centerline direction 45. The only force in that direction would be a resultant force based on the loading of the damper against the internal surface of the blade.

Turbine blade 22 also includes a plurality of internal cooling air passages 48 for the passage of cooling air through the blade. In the conventional manner the flow passes serially through a number of these passages and exits through cooling holes in the blade structure. The damper 28 is located in one of these cooling flow paths. It is noted that this damper is sufficiently small that it may be installed without blockage of more than 25% of the passage on which it is located. This permits the use of the damper in an air cooled blade without unduly restricting the air cooling thereof.

Flexural vibration of the blade is damped by longitudinal friction and slippage between the damper and the blade surface. Local micro-slipping will occur, with micro-slipping varying from a minimum near the damper support point to a maximum at the damper end.

Support of the damper is not really required for the damping action itself It is required to locate the damper. Support at an inboard location in the blade is preferred. Support at an outboard location requires a stiffer damper, since the centrifugal force tends to buckle the damper.

What is claimed is:

1. In a gas turbine engine having a rotor disk, a damped airfoil blade comprising:

a hollow airfoil blade secured to said disk and having interior surfaces, and having an effective radial length exposed to gas flow; and an internal damper comprising an elongated member having a damping surface of discrete width in contact with an interior surface continuously throughout a contact length which is greater than 50% of said effective radial length, in a direction having a radial component with respect to the center line of said rotor, said damping surface being the exclusive frictional contact between said damper and said blade.

2. A damped airfoil blade as in claim 1 comprising also:

said damper being stiffer in the direction parallel to said damping surface than in the direction perpendicular to said damping surface.

3. A damped airfoil blade as in claim 1:

said damping surface oriented in a direction at least 2° from the radial direction and less than 30° from the radial direction.

4. A damped airfoil blade as in claim 1 comprising also:

said damper rectangular in cross-section having a minor dimension between 0.04 and 0.06 inches and a maximum dimension between 0.1 and 0.2 inches.

5. A damped airfoil blade as in claim 1 comprising also:

said damper supported at a radially inboard position of said blade and extending outwardly therefrom

6. A damped airfoil blade as in claim 5, comprising also:

said damper located in a radial plane through the axis of said rotor.

7. A damped airfoil blade as in claim 1:

a plurality of cooling air passages through said blade;

said damper located in one of said cooling air passages; and said damper blocking less than 25% of the air passage containing said damper.

8. A damped airfoil blade as in claim 2:

said damping surface oriented in a direction at least 2° from the radial direction and less than 30° from the radial direction.

9. A damped airfoil blade as in claim 8 comprising also:

said damper rectangular in cross-section having a minor dimension between 0.04 and 0.06 inches and a maximum dimension between 0.1 and 0.2 inches.

10. A damped airfoil blade as in claim 9 comprising also:

said damper supported at a radially inboard position of said blade and extending outwardly therefrom.

11. A damped airfoil blade as in claim 10 comprising also:

said damper located in a radial plane through the axis of said rotor.

12. A damped airfoil blade as in claim 11:

a plurality of cooling air passages through said blade;

said damper located in one of said cooling air passages; and said damper blocking less than 25% of the air passage containing said damper.

* * * * *